US008774672B2

(12) United States Patent
Kato

(10) Patent No.: US 8,774,672 B2
(45) Date of Patent: Jul. 8, 2014

(54) IMAGE FORMING APPARATUS HAVING A HOLDING MEMBER FOR HOLDING A CARTRIDGE

(75) Inventor: Shuichi Kato, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 373 days.

(21) Appl. No.: 13/194,252

(22) Filed: Jul. 29, 2011

(65) Prior Publication Data

US 2012/0027455 A1 Feb. 2, 2012

(30) Foreign Application Priority Data

Jul. 29, 2010 (JP) ..... 2010-169985

(51) Int. Cl.
*G03G 15/00* (2006.01)

(52) U.S. Cl.
USPC ..... 399/110

(58) Field of Classification Search
USPC ..... 399/110
See application file for complete search history.

(56) References Cited

U.S. PATENT DOCUMENTS

| | | | | |
|---|---|---|---|---|
| 6,405,004 | B2 * | 6/2002 | Matsuzaki et al. | 399/111 |
| 6,708,011 | B2 | 3/2004 | Nomura et al. | |
| 2003/0053819 | A1 | 3/2003 | Nomura et al. | |
| 2007/0147881 | A1 | 6/2007 | Okabe et al. | |
| 2009/0092412 | A1 | 4/2009 | Kei | |
| 2010/0080615 | A1 | 4/2010 | Kikuchi | |
| 2010/0135694 | A1 | 6/2010 | Hashimoto et al. | |

FOREIGN PATENT DOCUMENTS

| | | |
|---|---|---|
| JP | 06-043706 | 2/1994 |
| JP | 2003-015378 A | 1/2003 |
| JP | 2005-107109 A | 4/2005 |
| JP | 2007-199649 | 8/2007 |
| JP | 2009-092914 | 4/2009 |
| JP | 2010-102304 A | 5/2010 |
| JP | 2010-128342 A | 6/2010 |

OTHER PUBLICATIONS

Decision to Grant for corresponding Japanese Patent Application No. 2010-169985 DTD. Jun. 5, 2012.

* cited by examiner

*Primary Examiner* — Quana M Grainger
(74) *Attorney, Agent, or Firm* — Banner & Witcoff, Ltd.

(57) ABSTRACT

An image forming apparatus includes: a body; a holding member movable between a housing position and a drawn-out position; a plurality of cartridges configured to be attached to the holding member along a attachment path, so that the plurality of cartridges are placed at image forming positions and are arranged in a movement direction of the holding member; and a plurality of restricting members disposed correspondingly with the cartridges. In a state where the holding member is drawn out to the drawn-out position, the plurality of restricting members are located at unrestricted positions that are retracted from the attachment path. In an attachment process in which the holding member is moved from the drawn-out position to the housing position, the plurality of restricting members advance from the unrestricted positions to restricting positions on the attachment path to restrict the cartridges from being detached from the image forming positions.

11 Claims, 8 Drawing Sheets

IMAGE FORMING APPARATUS HAVING A HOLDING MEMBER FOR HOLDING A CARTRIDGE

This application is based upon and claims the benefit of priority of Japanese Patent Application No. 2010-169985 filed on Jul. 29, 2010, the contents of which are incorporated herein by reference in its entirety.

BACKGROUND

The present discloses relates to an image forming apparatus such as a color printer.

A tandem type color printer is known which has a configuration where four photosensitive drums respectively for yellow, magenta, cyan, and black are integrally movable with respect to a body casing.

An example of a color printer of this kind includes four drum subunits in each of which a photosensitive drum is held by a frame. The four drum subunits are arranged at regular intervals in parallel between a pair of side plates. Front and rear beams are placed on both sides of the four drum subunits in the arrangement direction, respectively. The four drum subunits, the front beam, and the rear beam are collectively clamped by the pair of side plates, thereby configuring a drum unit which is movable with respect to a body casing.

When the drum unit is drawn out from the body casing in the arrangement direction of the photosensitive drums, the drum unit can be placed in a drawn-out position where the side above the drum unit is opened. When the drum unit is pushed from the drawn-out position into the body casing, the drum unit can be returned to a housing position in the body casing. In the state where the drum unit is drawn out to the drawn-out position, a developing cartridge can be attached to the drum unit.

A developing cartridge is attached into a space disposed on the front beam side of each of the drum subunits. The developing cartridge includes a developing roller. The developing roller has a developing roller shaft which is rotatably held by a case of the developing cartridge. Both end portions of the developing roller shaft are projected to the outside from the case of the developing cartridge.

Guide grooves for guiding attachment and detachment of the developing cartridge are formed in the inner surfaces of the side plates. When the developing cartridge is to be attached to the drum unit, the end portions of the developing roller shaft are inserted from the upper side into the guide grooves, and the developing cartridge is moved toward the drum unit so that the end portions are downward moved along the guide grooves. When the developing cartridge moves further and the developing roller is in contact with the photosensitive drum, the developing cartridge is restricted to move further. Thereafter, the developing cartridge is tilted toward the front beam about the developing roller shaft to complete the attachment of the developing cartridge to the drum unit.

A pressing projection is disposed in the developing cartridge. In the state where the developing cartridge is attached to the drum unit, the pressing projection is pressed from the upper side by a pressing/releasing mechanism disposed in the body casing. Therefore, the developing roller is pressingly contacted with the photosensitive drum by an adequate pressing force.

After the developing cartridge is attached to the drum unit, the drum unit is moved from the drawn-out position to the housing position in the body casing. At this time, in the case where the drum unit is vigorously moved toward the housing position, when the drum unit is located at the housing position, a large shock (reaction) is applied to the drum unit and the developing cartridge. There is a possibility that the developing cartridge may be detached from the drum unit by the shock.

An aspect of the disclosure is to provide an image forming apparatus in which it is possible to prevent a cartridge from being accidentally detached from an image forming position where an image forming operation is performed.

The aspect of the disclosure provides:

an image forming apparatus comprising:

a body;

a holding member configured to be movable between a housing position where the holding member is accommodated in the body, and a drawn-out position where the holding member is drawn out to an outside of the body;

a plurality of cartridges configured to be attached to the holding member along a attachment path, so that the plurality of cartridges are placed at image forming positions and are arranged in a movement direction of the holding member; and a plurality of restricting members configured to be disposed correspondingly with the cartridges, wherein in a state where the holding member is drawn out to the drawn-out position, the plurality of restricting members are located at unrestricted positions that are retracted from the attachment path, wherein in an attachment process in which the holding member is moved from the drawn-out position to the housing position, the plurality of restricting members advance from the unrestricted positions to restricting positions on the attachment path to restrict the cartridges from being detached from the image forming positions.

In a state where the holding member is drawn out to the drawn-out position, moreover, the restricting member is retracted from the attachment path of the cartridge, and hence attachment and detachment of the cartridge to and from the holding member are not impeded.

DESCRIPTION OF EXEMPLARY EMBODIMENTS

Hereinafter, an exemplary embodiment will be described in detail with reference to the accompanying drawings.

1. Color Printer

Figure 1:
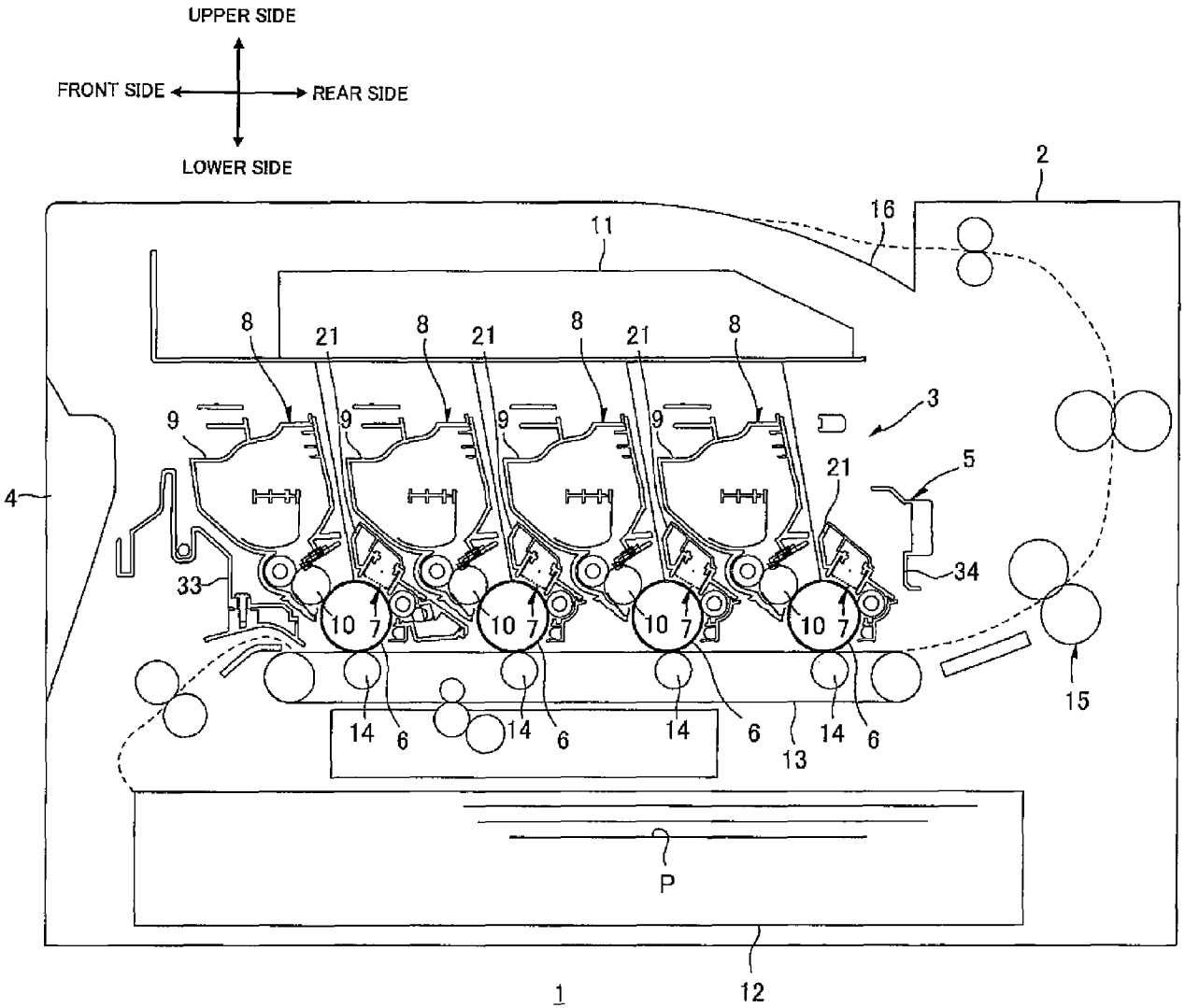
FIG. 1 is a sectional view of a color printer of an embodiment of the invention, showing a state where a tandem type drum unit is located at a housing position.
Figure 8:
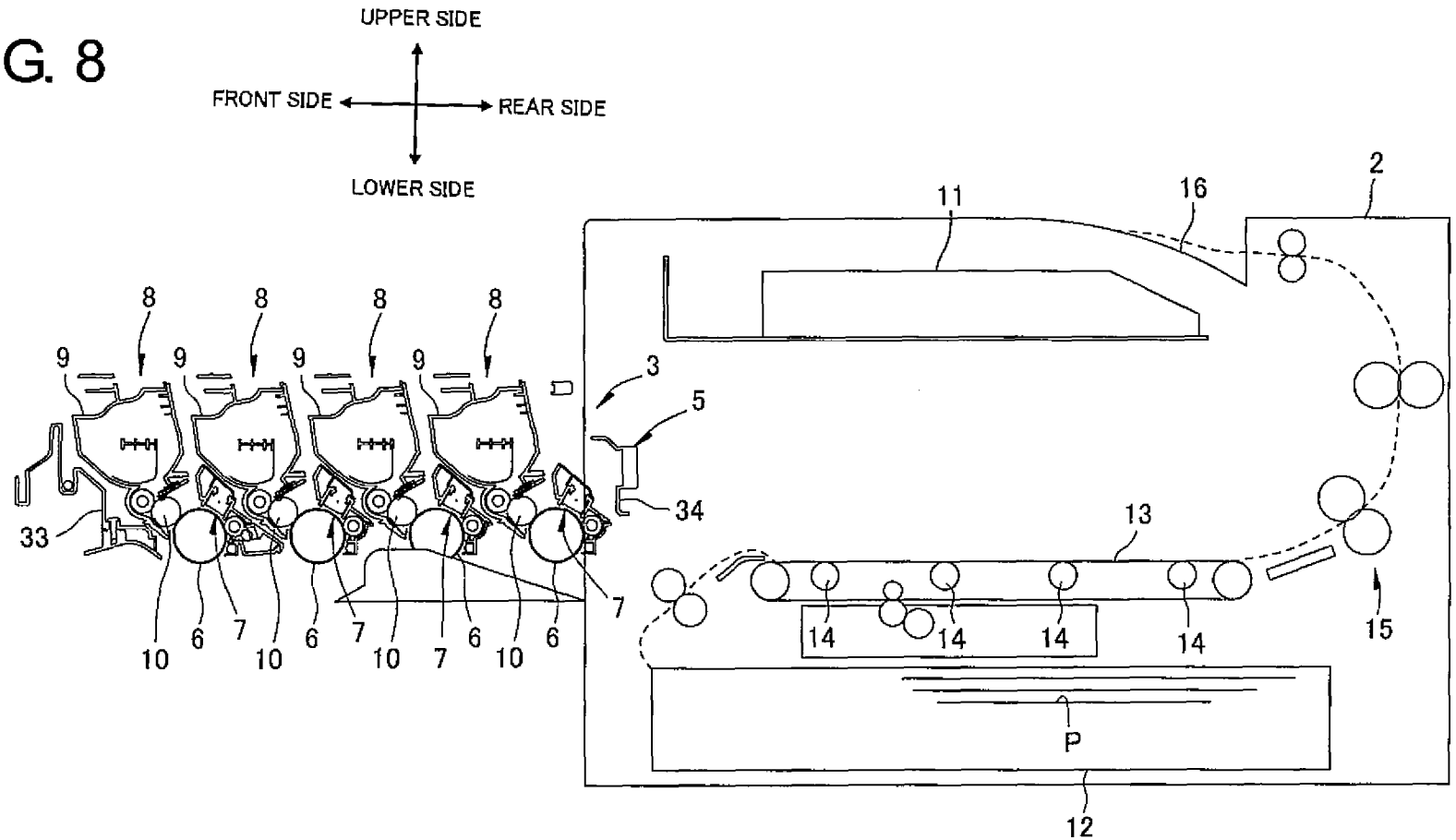
FIG. 8 is a sectional view of the color printer of FIG. 1, showing a state where the tandem type drum unit is located at a drawn-out position.

As shown in FIGS. 1 and 8, a color printer 1 which is an example of an image forming apparatus includes a body casing 2 which is an example of the apparatus body. A tandem type drum unit 3 is attached into the body casing 2. A front cover 4 is openably disposed on the front surface of the body casing 2. In a state where the front cover 4 is opened, the tandem type drum unit 3 can be horizontally moved between a housing position (the position shown in FIG. 1) in the body casing 2, and a drawn-out position (the position shown in FIG. 8) outside the body casing 2.

The side where the front cover 4 is disposed (the left side in FIG. 1) is referred as the front side of the color printer 1. With respect to the upper, lower, right, and left sides of the color printer 1, the side of the color printer 1 as seen from the front side is set as the reference. The tandem type drum unit 3 will be described while setting the direction in the state where the unit is attached to the body casing 2, as the reference unless other stated.

The tandem type drum unit 3 includes a unit frame 5 which is an example of a holding member. Four photosensitive drums 6 which are an example of photosensitive drums are held by the unit frame 5 so as to be rotatable about respective rotation axes which laterally extend. The four photosensitive drums 6 are disposed for black, yellow, magenta, and cyan, respectively, and are arranged in parallel at regular intervals in the anteroposterior direction in the sequence of black, yellow, magenta, and cyan with starting from the front side.

In the unit frame 5, four charging devices 7 are held between a pair of side plates. The four charging devices 7 are disposed correspondingly with the photosensitive drums 6, and placed in the upper rear sides of the corresponding photosensitive drums 6, respectively. For example, the charging devices 7 are scorotron charging devices each having a wire and a grid.

The tandem type drum unit 3 includes four developing cartridges 8 which are an example of four cartridges that are detachable with respect to the unit frame 5. The four developing cartridges 8 are disposed correspondingly with the photosensitive drums 6, respectively. In the state where the tandem type drum unit 3 is drawn out to the drawn-out position, each of the developing cartridges 8 is attached from the upper side of the unit frame 5, and placed in the upper front side of the corresponding photosensitive drum 6.

Each of the developing cartridges 8 includes a case 9, and a developing roller 10 which is held by the case 9, and which is an example of a developer carrier. The developing roller 10 is disposed so as to be rotatable about a rotation axis which laterally extends, and a part of the surface (circumferential surface) of the roller is exposed from the case 9. In the state where the developing cartridge 8 is attached to the unit frame 5, the surface of the developing roller 10 is in contract with that of the photosensitive drum 6 from the upper front side.

In the body casing 2, an exposing device 11 which emits four laser beams respectively corresponding to the colors is placed above the tandem type drum unit 3.

In accordance with rotation of each of the photosensitive drums 6, the surface of the photosensitive drum 6 is uniformly charged by discharging of the charging device 7, and then selectively exposed by the laser beam emitted from the exposing device 11. This exposure causes charges on the surface of the photosensitive drum 6 to be selectively removed therefrom, and an electrostatic latent image is formed on the surface of the photosensitive drum 6. When the electrostatic latent image is opposed to the developing roller 10, a toner is supplied from the developing roller 10 to the electrostatic latent image. As a result, a toner image is carried on the surface of the photosensitive drum 6.

In place of the exposing device 11, four LED arrays may be disposed correspondingly with each of the photosensitive drums 6.

A sheet supply cassette 12 which houses sheets P is placed in a bottom portion of the body casing 2. The sheets P housed in the sheet supply cassette 12 are conveyed onto a conveying belt 13 by various rollers. The conveying belt 13 is placed while being opposed to the lower sides of the four photosensitive drums 6. Transfer rollers 14 are placed at positions which are opposed to the photosensitive drums 6 across an upper side portion of the conveying belt 13, respectively. When the conveying belt 13 runs, the sheet P which is conveyed onto the conveying belt 13 is sequentially passed between the conveying belt 13 and the photosensitive drums 6. The toner image on the surface of each of the photosensitive drums 6 is transferred to the sheet P when the toner image is opposed to the sheet P in the gap between the photosensitive drum 6 and the corresponding transfer roller 14.

A fixing device 15 is disposed downstream of the conveying belt 13 in the conveying direction of the sheet P. The sheet P onto which toner images have been transferred is conveyed to the fixing device 15. In the fixing device 15, the toner images are fixed to the sheet P by heat and pressure. The sheet P onto which the toner images have been fixed is discharged to a sheet discharge tray 16 by various rollers on the upper surface of the body casing 2.

2. Tandem Type Drum Unit (1) Drum Subunit

Figure 2:
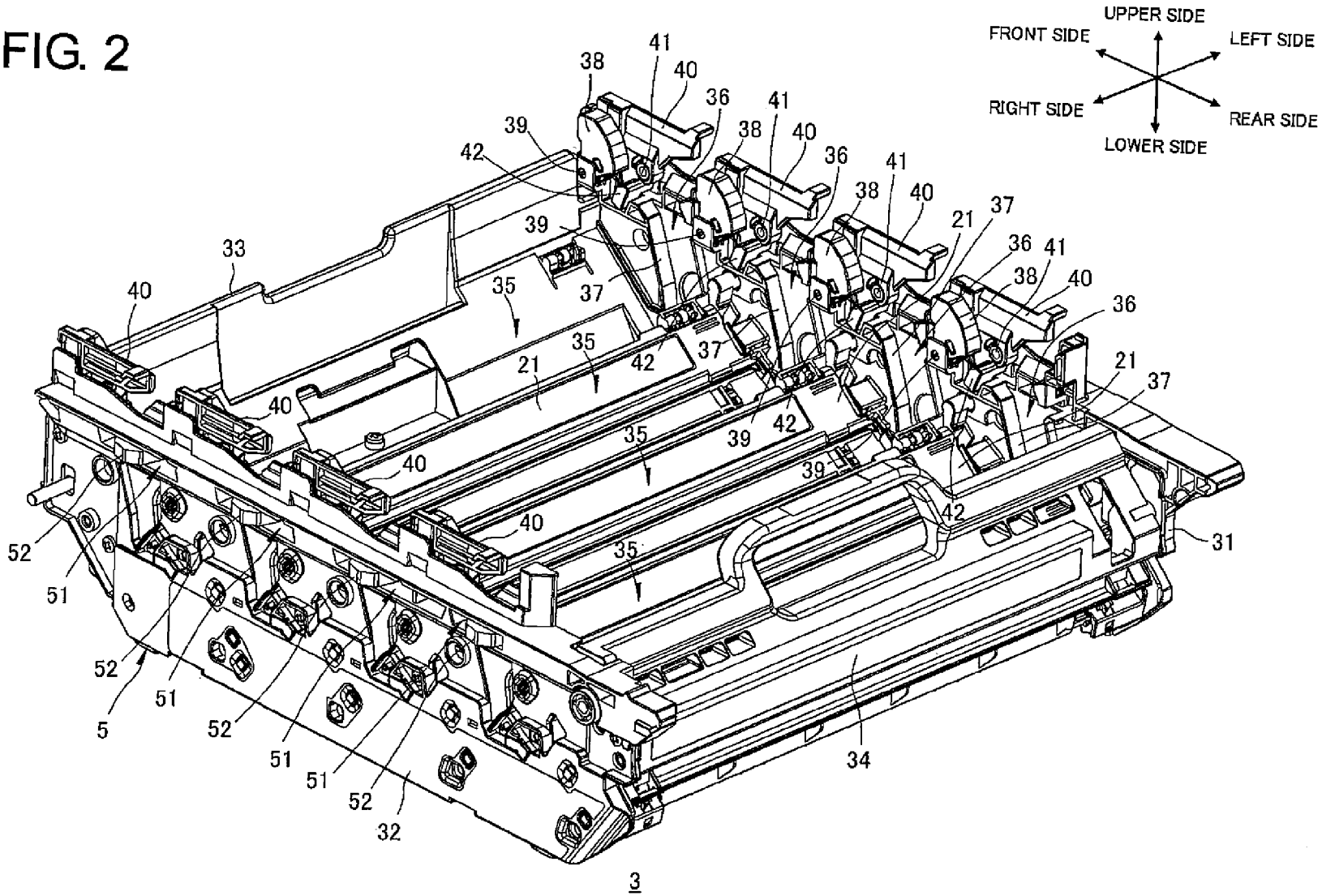
FIG. 2 is a perspective view of the tandem type drum unit shown in FIG. 1, as seen from the upper right rear side.
Figure 3:
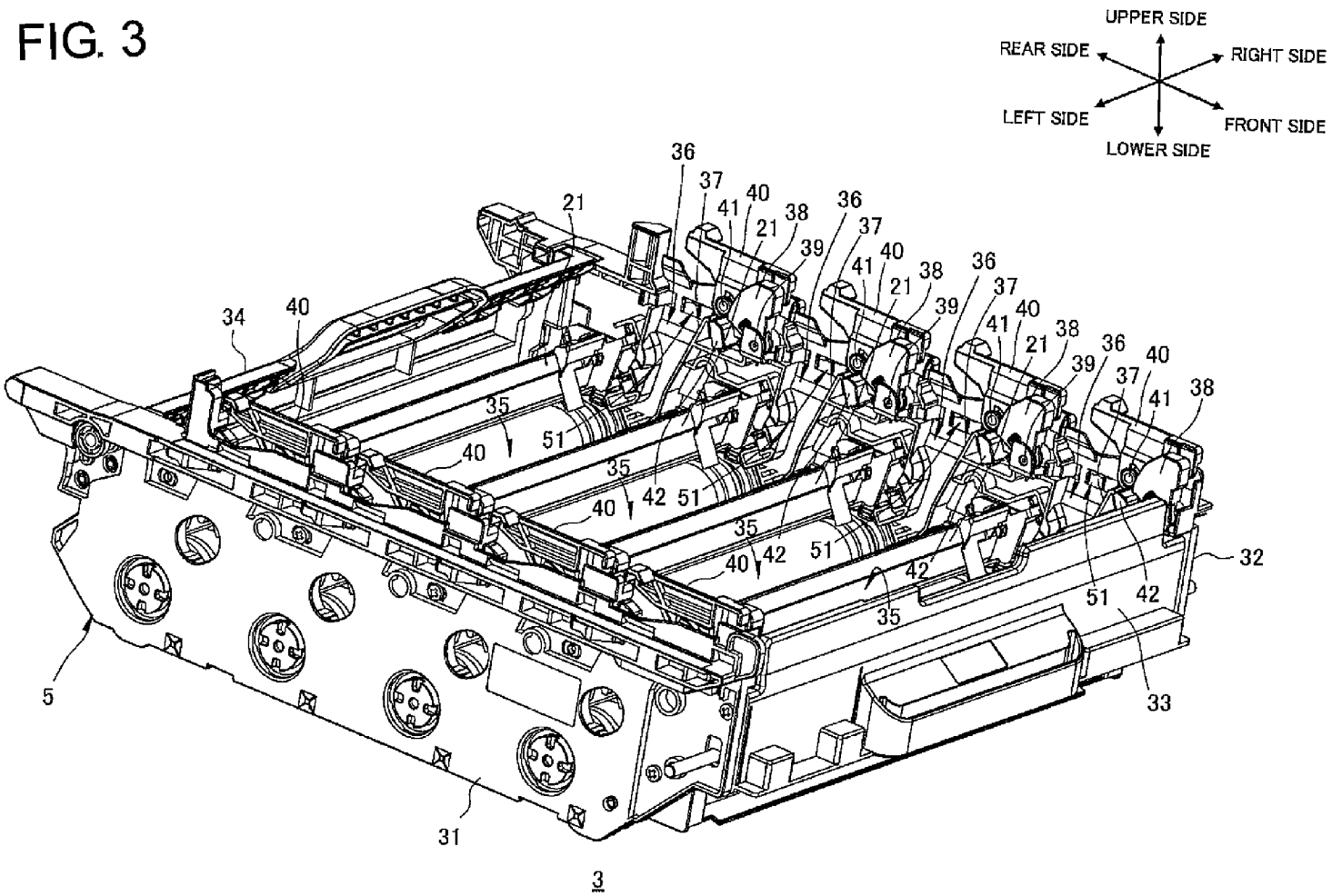
FIG. 3 is a perspective view of the tandem type drum unit shown in FIG. 1, as seen from the upper left front side.

In the tandem type drum unit 3, as shown in FIGS. 1 to 3, each of the photosensitive drum 6, and the charging device 7 which is disposed correspondingly with the photosensitive drum 6 are held by a common subunit frame 21 to constitute a drum subunit 22.

(2) Unit Frame

As shown in FIGS. 2 and 3, the unit frame 5 includes: a pair of side plates 31, 32; a front beam 33 which is hung between front end portions of the pair of side plates 31, 32; and a rear beam 34 which is hung between rear end portions of the pair of side plates 31, 32. The four drum subunits 22 are arranged at regular intervals in the anteroposterior direction between the pair of side plates 31, 32, and hung between the pair of side plates 31, 32. In other words, the pair of side plates 31, 32 are coupled together through the four subunit frames 21, the front beam 33 which is placed in front of the foremost subunit frame 21, and the rear beam 34 which is placed in rear of the rearmost subunit frame 21. In more other words, the unit frame 5 includes: the four subunit frames 21; the front beam 33 which is placed in front of the foremost subunit frame 21; the rear beam 34 which is placed in rear of the rearmost subunit frame 21; and the pair of side plates 31, 32 which sandwich collectively laterally these members, and as a whole forms a ladder-like structure. A gap which is substantially equal to the gap between adjacent one of the subunit frames 21 is formed between the foremost subunit frame 21 and the front beam 33.

A space which is disposed in front of each of the subunit frames 21 is formed as a developing cartridge attaching portion 35 having a space into which the developing cartridge 8 (see FIG. 1) is to be attached. Between the pair of side plates 31, 32, namely, four developing cartridge attaching portions 35 each having a space for attachment of the developing cartridge 8 are defined by the subunit frames 21 and the front beam 33. As described later, the developing cartridges 8 are attached to the developing cartridge attaching portions 35 from the upper sides, respectively.

(3) Developing Cartridge Guiding Portion

Developing cartridge guiding portions 36 for guiding attachment and detachment of the developing cartridges 8 to and from the developing cartridge attaching portions 35 are formed in the inner surfaces of the side plates 31, 32. More specifically, projection walls (ridge-like walls) 37 which are projected toward the developing cartridge attaching portions 35 are formed on the inner surfaces of the side plates 31, 32. Each of the projection walls 37 forms a substantially U-like shape in which the upper end is configured as an open end, and the width is larger as further advancing upward. Areas inside the projection walls 37 (areas defined by the projection walls 37) are the developing cartridge guiding portions 36.

According to the configuration, each of the developing cartridge guiding portions 36 is upward opened, extended substantially vertically downward from the upper end of the opening, and bent in the middle rearward downward to extend toward the photosensitive drum 6. Therefore, the direction of guiding of the developing cartridge 8 by the developing cartridge guiding portion 36 contains two directions, i.e., a substantially vertical direction, and a direction which is inclined rearward downward. The direction which is inclined rearward downward coincides with that in which the developing roller 10 is pressed against the photosensitive drum 6 by pressing against the developing cartridge 8 (bosses 65) by a pressing member 38 that will be described later, and that in which the developing roller 10 is separated from the photosensitive drum 6 by pushing up of the developing cartridge 8 (the bosses 65) by a separating member 40 that will be described later.

(4) Pressing Member

Four pressing members 38 are disposed in each of the side plates 31, 32. The pressing members 38 are placed to positions which are laterally opposed to the developing cartridge attaching portions 35. Each of the pressing members 38 has a plate-like shape which, in a side view, has a substantially sector-like shape where a part of the circumferential surface is cut away from a sector of a central angle of about 60°. A support shaft 39 which laterally extends is rotatably passed through the vicinity of the center of the sector shape of the pressing member 38. The support shaft 39 is nonrotatably supported by the side plates 31, 32. Therefore, the pressing member 38 is disposed so as to be swingable about the support shaft 39. The pressing member 38 is urged in a clockwise direction as seen from the right side by a wire spring which is not shown.

(5) Separating Member

Four separating members 40 are disposed in each of the side plates 31, 32. Each of the separating members 40 has a substantially right triangular shape in a side view, and is placed so that the rectangularly angled portion is laterally opposed from the outside to the corresponding pressing member 38, and the remaining two angled portions are located in rear of and below the pressing member 38, respectively. A support shaft 41 which laterally extends is rotatably passed through the separating member 40 at a position in rear of the pressing member 38. The support shaft 41 is nonrotatably supported by the side plates 31, 32. Therefore, the separating member 40 is disposed so as to be swingable about the support shaft 41. The separating member 40 is urged in a counterclockwise direction as seen from the right side by a wire spring which is not shown.

A pushing-up portion 42 is integrally projected from a lower end portion of the separating member 40. The pushing-up portion 42 extends from the laterally inner side surface of the separating member 40 to a position which is opposed to the pressing member 38 while forming a gap, from the lower rear side.

(6) Restricting Member

In an upper end portion of the right side plate 32, four recesses 51 are formed correspondingly with the developing cartridge attaching portions 35. Each of the recesses 51 is recessed from the outer side surface (right side surface) of the side plate 32 in a rectangular shape in a side view. A restricting member 52 is disposed in the recess 51.

Figure 4:
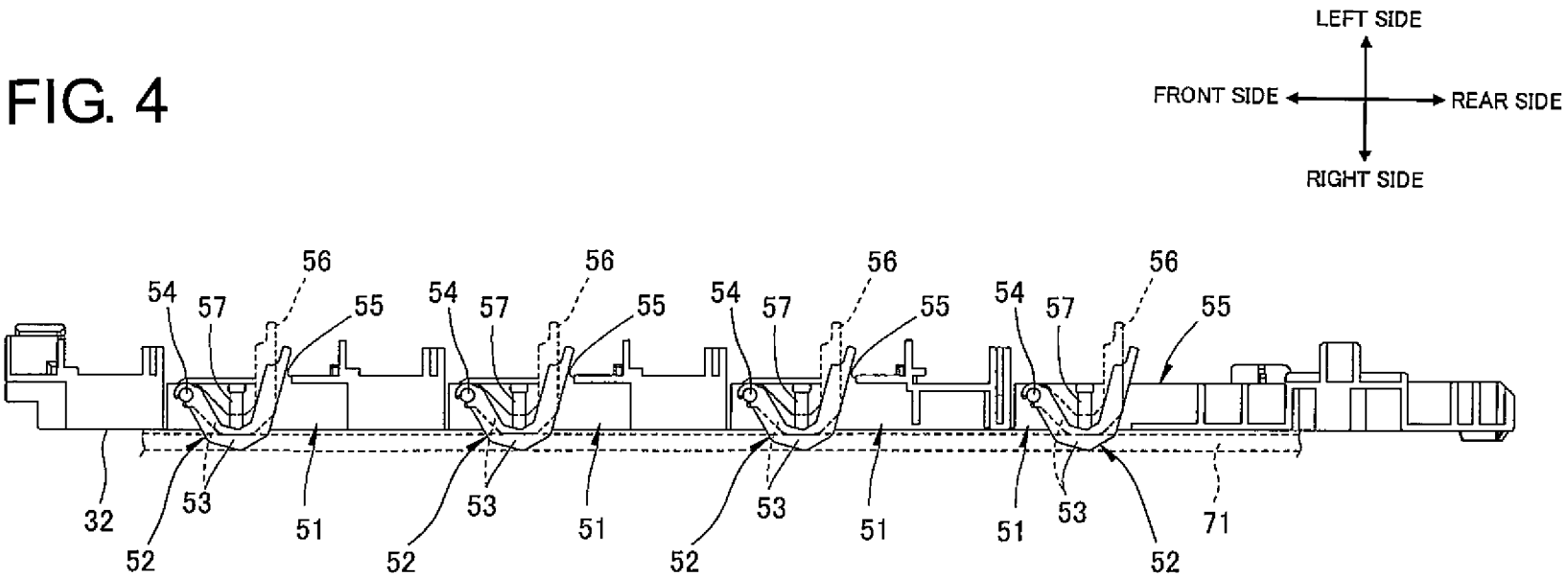
FIG. 4 is a schematic sectional view of a right side wall shown in FIG. 2.

As shown in FIG. 4, the restricting member 52 has a substantially V-like shape in a plan view. The restricting member 52 is disposed so that a bent portion 53 is placed relatively in the right side, and the open end is placed relatively in the left side. One end portion which forms one side of the open end of the restricting member 52 is swingably held by a swing shaft 54 which upstands on a front end portion of the recess 51, and which vertically extends. The other end portion (the other end portion placed in the rear side) which forms the other side of the open end of the restricting member 52 is placed in rear of the one end portion. A through hole 55 through which the interior of the recess 51 communicates with the space on the left side of the side plate 32 is formed in the side plate 32. The other end portion of the restricting member 52 is projected to the left side of the side plate 32 through the through hole 55. A restricting portion 56 is extended in the other end portion of the restricting member 52. The restricting portion 56 has a rectangular shape which is vertically elongated as seen in the extension direction with respect to the other end portion of the restricting member 52.

A coil spring 57 which is an example of an urging member is interposed in a compressed state between the bent portion 53 of the restricting member 52 and a portion of the side plate 32 which faces the interior of the recess 51. The bent portion 53 of the restricting member 52 is urged toward the right side by the coil spring 57.

3. Developing Cartridge

Figure 5:
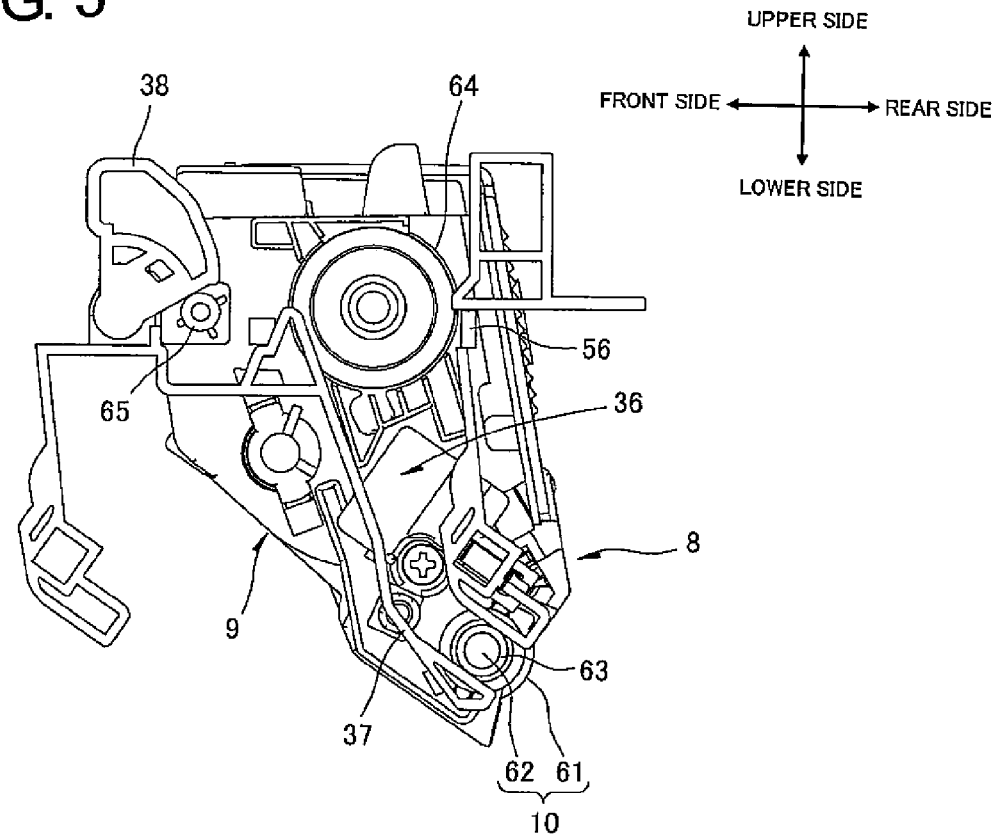
FIG. 5 is a right side view of a developing cartridge shown in FIG. 1, showing a state where the developing cartridge is located at an image forming position (a state where the cartridge is in an attachment posture).
Figure 6:
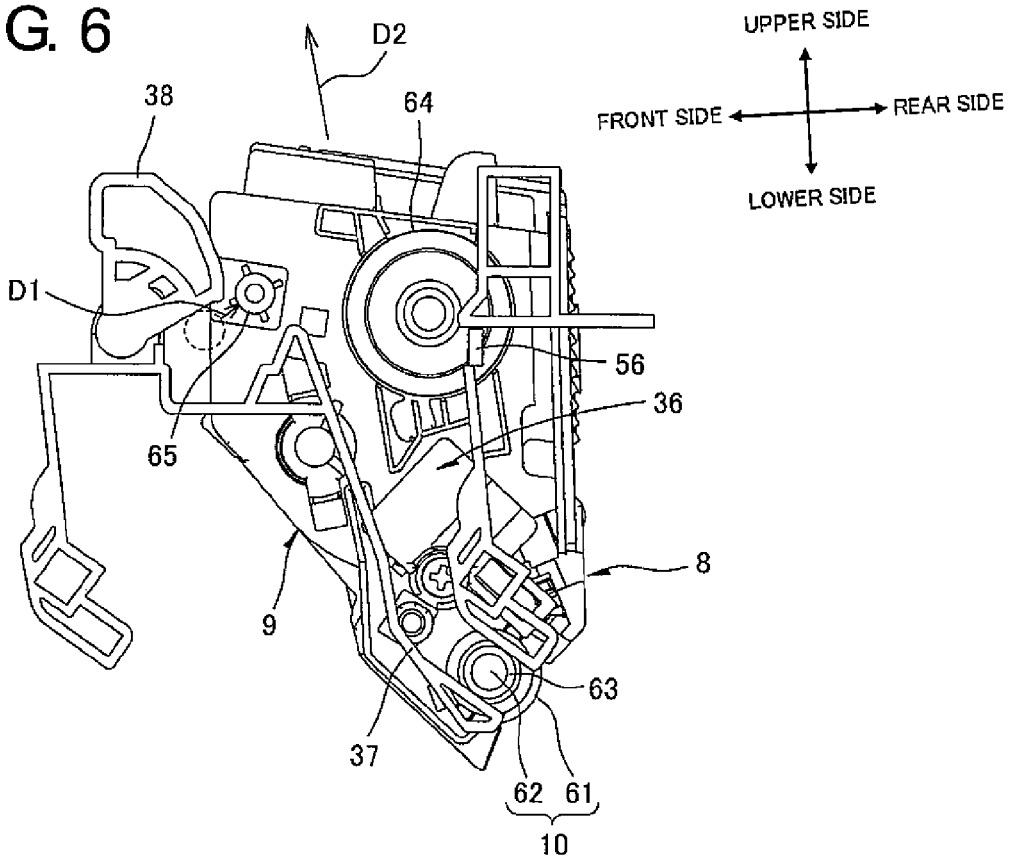
FIG. 6 is a right side view of the developing cartridge shown in FIG. 1, showing a state where the developing cartridge is in a release posture.

As shown in FIGS. 5 and 6, the case 9 of each of the developing cartridges 8 has, in a side view, a substantially triangular shape in which a lower end portion is narrowed.

The developing roller 10 is held by the lower end portion of the case 9. Specifically, the developing roller 10 has: a columnar roller body 61 which is centered on a laterally extending axis; and a roller shaft 62 which is passed through the roller body 61 along the center axis. Both end portions of the roller shaft 62 are projected from the right and left end faces of the roller body 61, and passed through the right and left side faces of the case 9 to be rotatably held by the case 9, respectively. Cylindrical shaft covers 63 are attached to portions (both end portions) of the roller shaft 62 which are projected from the case 9, respectively.

A cylindrical rib 64 which is an example of a restricted portion is formed while being rightward projected, in an upper rear end portion of the right side surface of the case 9. A toner filling port which is to be used for filling a toner into the case 9 is formed in a portion surrounded by the cylindrical rib 64. A cap which closes the toner filling port is placed in the port.

Bosses 65 are projected from upper front end portions of the right and left side surfaces of the case 9, respectively.

4. Attachment of Developing Cartridge

When the developing cartridges 8 are to be attached to the unit frame 5 (the developing cartridge attaching portions 35), the tandem type drum unit 3 is drawn out to the drawn-out position outside the body casing 2. In the state where the tandem type drum unit 3 is drawn out to the drawn-out position, no other member is in contact with the restricting member 52, the restricting member 52 is located at an unrestricted position where, by the urging force of the coil spring 57 as indicated by the solid line in FIG. 4, the bent portion 53 is largely projected from the outer side surface of the right side plate 32 of the unit frame 5, and the restricting portion 56 is retracted from an attachment path of the developing cartridge 8 with respect to the developing cartridge attaching portion 35.

After the tandem type drum unit 3 is drawn out to the drawn-out position, the developing cartridge 8 is placed above the developing cartridge attaching portion 35, and, in a posture in which the developing roller 10 is downward directed, moved toward the developing cartridge attaching portion 35. In the course of the movement, the shaft covers 63 in the both end portions of the roller shaft 62 are inserted from the upper side into the developing cartridge guiding portion 36. In accordance with the movement of the developing cartridge 8, thereafter, the shaft covers 63 are guided by the developing cartridge guiding portion 36, and moved in a direction in which the developing roller 10 approaches the photosensitive drum 6. When the developing roller 10 is in contacted with the photosensitive drum 6, the developing cartridge 8 is restricted to move further.

Thereafter, an upper end portion of the developing cartridge 8 is forward pushed. This causes the developing cartridge 8 to be tilted to the front side about the shaft covers 63. The bosses 65 are passed between the pressing members 38 and the pushing-up portion 42 of the separating members 40 to slip below the pressing members 38, and push up the pressing members 38 against the urging force of the wire spring which is not shown. Then, the developing cartridge 8 leans against the subunit frame 21 or the front beam 33, the case 9 butts against the subunit frame 21 or the front beam 33, and further tilting of the developing cartridge 8 is blocked, thereby completing the attachment of the developing cartridge 8 to the developing cartridge attaching portion 35. The position of the developing cartridge 8 at this time coincides with that of the developing cartridge 8 in the image formation, i.e., the image forming position. In this state, as shown in FIG. 5, the pressing members 38 press the bosses 65 from the upper front side, and the developing roller 10 is pressingly contacted with the photosensitive drum 6.

5. Regulation by Restricting Member

In the body casing 2, as indicated by the broken line in FIG. 4, a rib-like butting member 71 which extends in the anteroposterior direction is disposed at a position which is opposed to the bent portion 53 of the restricting member 52 in the movement direction of the tandem type drum unit 3, i.e., the anteroposterior direction.

According to the configuration, when the tandem type drum unit 3 is moved from the drawn-out position to the housing position after the completion of attachment of the developing cartridges 8 to the developing cartridge attaching portions 35, the bent portions 53 of the four restricting members 52 sequentially butt against the butting member 71 in the course of the attachment (during the movement). This butting causes the bent portions 53 to be moved while being leftward pressed against the urging threes of the coil springs. As a result, the restricting members 52 are moved from the unrestricted positions indicated by the solid lines in FIG. 4, to restricted positions indicated by the broken lines in FIG. 4. In the state where the restricting members 52 are located at the restricted positions, as compared with the state where the restricting members 52 are located at the unrestricted positions, the restricting portions 56 are largely projected to the left side from the right side plate 32. As shown in FIG. 5, then, the restricting portions 56 are opposed to the cylindrical ribs 64 of the developing cartridges 8 while forming small gaps in rear of the ribs.

When the developing cartridges 8 are to be detached from the developing cartridge attaching portions 35, contrarily to the attachment of the developing cartridges 8, the upper end portion of each of the developing cartridges 8 is rearward pushed, and the developing cartridge 8 is tilted to the rear side about the shaft covers 63. As shown in FIG. 6, this causes the bosses 65 to slip out to the rear side from below the pressing members 38. At this time, the developing cartridge 8 is moved via a first path D1 from the attachment posture which is formed at the position (image forming position) where the bosses 65 are pressed by the pressing members 38, to a release posture where the pressurization by the pressing members 38 on the bosses 65 is released. Thereafter, the developing cartridge 8 is pulled up along the developing cartridge guiding portions 36, and moved via a second path D2 to be detached from the developing cartridge attaching portion 35.

In the state where the restricting member 52 is located at the restricted position, the restricting portion 56 is opposed to the cylindrical rib 64 from the rear side, and, when the developing cartridge 8 tries to be moved via the first path D1, the cylindrical rib 64 therefore butts against the restricting portion 56. This causes the cylindrical rib 64 to be blocked moving, and the developing cartridge 8 via the first path D1 to be blocked moving. In the state where the restricting member 52 is located at the restricted position, namely, the restricting portion 56 advances into the first path D1, and the developing cartridge 8 is blocked from separating from the image forming position.

6. Positioning of Tandem Type Drum Unit

Figure 7:
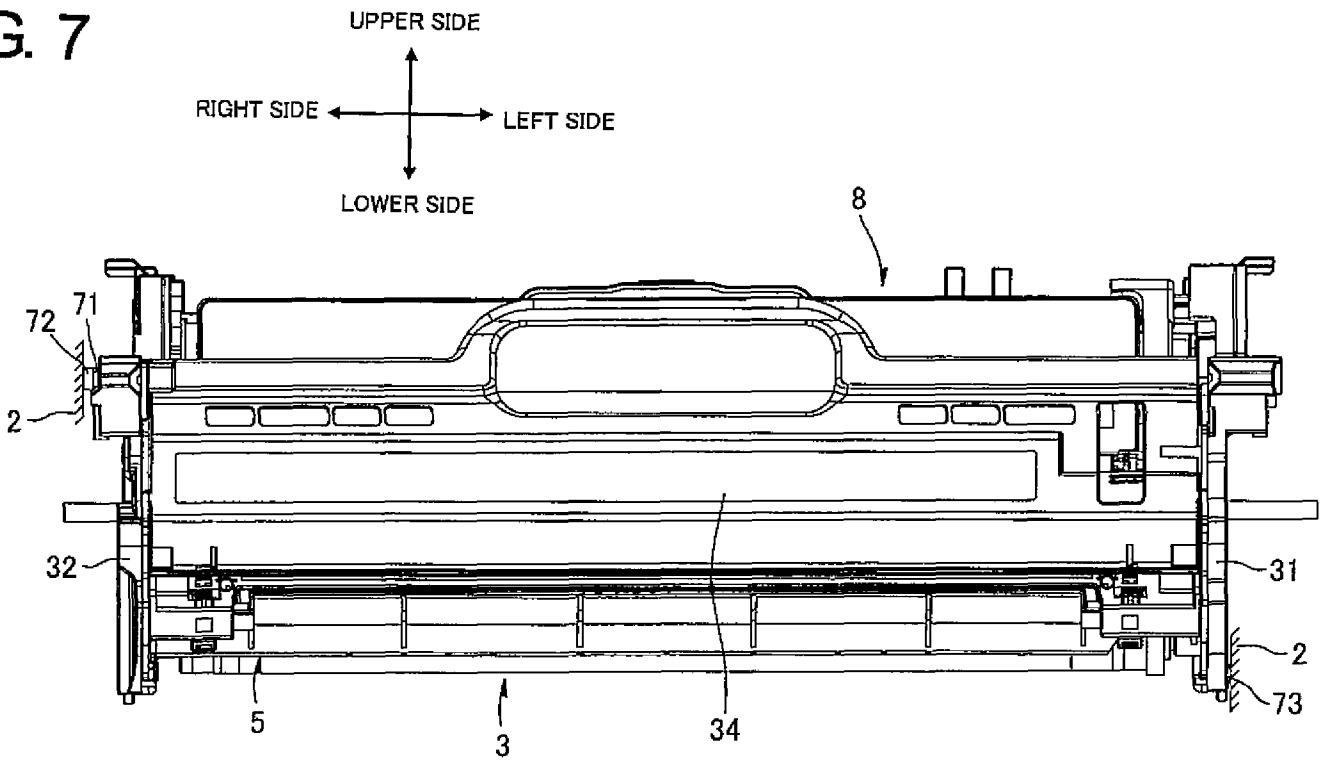
FIG. 7 is a rear view (a view as seen from the rear side) of the tandem type drum unit shown in FIG. 1.

As shown in FIG. 7, an urged portion 71 is disposed in, for example, an upper end portion of the outer side surface of the right side plate 32 of the tandem type drum unit 3 (the unit frame 5). In the body casing 2, an urging member 72 which urges the urged portion 71 from the right side to the left side when the tandem type drum unit 3 is located at the housing position in the body casing 2 is disposed correspondingly with the urged portion 71.

On the other hand, a positioning portion 73 is disposed in, for example, the outer side surface of the left side plate 31 of the tandem type drum unit 3.

When the tandem type drum unit 3 is located at the housing position in the body casing 2, a leftward urging force is applied from the urging member 72 to the urged portion 71. This causes the tandem type drum unit 3 to be pushed leftward, and the positioning portion 73 butts against the left inner side surface of the body casing 2. As a result, the tandem type drum unit 3 is laterally positioned in the body casing 2.

7. Separation of Developing Roller from Photosensitive Drum

The color printer 1 has, as operation modes, a color mode where a color image is formed on the sheet P, and a monochrome mode where a monochrome image is formed on the sheet P. In the color mode, the developing rollers 10 are pressed against all the photosensitive drums 6, respectively. In the monochrome mode, the developing roller 10 is pressed against the photosensitive drum 6 for black, and the developing rollers 10 are separated from the photosensitive drums 6 for yellow, magenta, and cyan, respectively.

The separation of the developing roller 10 from the photosensitive drum 6 is achieved by pushing up the bosses 65 of the developing cartridge 8 by the pushing-up portions 42 of the separating members 40. Namely, the separating members 40 are swung in a clockwise direction as seen from the right side against the urging forces of the wire springs which is not shown, by an operation of a linear motion cam or the like which is not shown. In accordance with the swinging operations of the separating members 40, the pushing-up portions 42 butt against the bosses 65 from the lower side to upward press the bosses 65. This causes the bosses 65 to be pushed up by the pushing-up portions 42 to push up the pressing members 38 against the urging force of the wire spring which is not shown. As a result, the developing cartridge 8 is raised, and the developing roller 10 is separated from the photosensitive drum 6. Since, at this time, the developing cartridge 8 is not moved along the first path D1, the restricting portions 56 do not impede the movement of the developing cartridge 8 even when the restricting portions 56 advance into the first path D1.

When the pressurization by the pushing-up portions 42 on the bosses 65 is released, the bosses 65 are pushed down by the pressing members 38, and the developing roller 10 is again pressingly contacted with the photosensitive drum 6.

8. Effects (1) Effect 1

As described above, the unit frame 5 is movable between the housing position where the unit is accommodated in the body casing 2, and the drawn-out position where the unit is drawn out to the outside of the body casing 2. The plurality of developing cartridges 8 are held by the unit frame 5 in the state where the cartridges are arranged in the movement direction of the unit frame 5. Each of the developing cartridges 8 is attached to the unit frame 5 along the first path D1, and the second path D2, and placed at the image forming position in the state where the cartridge is attached to the unit frame 5.

The four restricting members 52 are disposed correspondingly with the developing cartridges 8, respectively. In the state where the unit frame 5 is drawn out to the drawn-out position, the restricting members 52 are located at the unrestricted positions where the members are retracted from the first path D1. In the attachment process in which the unit frame 5 is moved from the drawn-out position from the unrestricted position to the housing position, the restricting members 52 advance toward the restricted positions on the first path D1, and, in the state where the restricting members are located at the restricted positions, the developing cartridges 8 are restricted from being separated from the image forming positions (from being detached from the unit frame 5).

Even in the case, when the unit frame 5 is placed (positioned) at the housing position, a shock is applied to the unit frame 5 and the developing cartridges 8, it is possible to prevent the developing cartridges 8 from being accidentally detached from the image forming positions by the shock.

In the state where the unit frame 5 is drawn out to the drawn-out position, the restricting members 52 are retracted from the first path D1 for the developing cartridges 8, the members do not impede attachment and detachment of the developing cartridges 8.

(2) Effect 2

The butting member 71 is disposed in the body casing 2. The restricting members 52 are projected from the unit frame 5 at the unrestricted positions. In the attachment process in which the unit frame 5 is moved from the drawn-out position to the housing position, the portions of the restricting members 52 which are projected from the unit frame 5 butt against the butting member 71, and receive a pressing force from the butting member 71, whereby the restricting members 52 are moved from the unrestricted positions to the restricted positions. In accordance with the movement of the unit frame 5 from the drawn-out position to the housing position, the restricting members 52 can be surely moved from the unrestricted positions to the restricted positions.

(3) Effect 3

Each of the restricting members 52 is urged toward the unrestricted position by the coil spring 57. In the state the unit frame 5 is drawn out to the drawn-out position, therefore, the restricting member 52 can be surely located at the unrestricted position, and the restricting member 52 can be surely prevented from impeding the attachment of the developing cartridge 8.

(4) Effect 4

Each of the developing cartridges 8 has the cylindrical rib 64 which is projected from the case 9 toward the outside. The restricting member 52 is placed at the restricted position so as to be opposed to the cylindrical rib 64 of the developing cartridge 8 which is placed at the image forming position, while forming a predetermined gap. Therefore, the developing cartridge 8 does not receive any force from the restricting member 52 unless the developing cartridge 8 is moved from the image forming position. As a result, a change of the butting state of the developing roller 10 with respect to the photosensitive drum 6 can be avoided, and the quality of an image to be formed on the sheet P can be prevented from being lowered.

(5) Effect 5

Each of the developing cartridges 8 which are placed at the image forming positions is pressed by the pressing member 38 to be positioned with respect to the unit frame 5. The attachment path of the developing cartridge 8 includes: the first path D1 through which the developing cartridge is passed when the developing cartridge 8 is displaced between the attachment posture that is formed when the developing cartridge 8 is placed at the image forming position, and the release posture that is formed when the pressing on the developing cartridge 8 is released; and the second path D2 through which the developing cartridge is passed when the developing cartridge 8 is to be displaced between the release posture and the state where the developing cartridge is detached from the unit frame 5.

The restricting member 52 advances into the first path D1 at the restricted positions, and placed downstream of the cylindrical rib 64 in the direction of the movement of the developing cartridge 8 when the developing cartridge is displaced from the attachment posture to the release posture. Even when a shock is applied to the unit frame 5 and the developing cartridges 8 and inertia acts on the developing cartridge 8 in the direction of the displacement from the attachment posture to the release posture, therefore, the cylindrical rib 64 butts against the restricting member 52, whereby the developing cartridge 8 is blocked from being displaced. As a result, the developing cartridge 8 can be surely prevented from being accidentally detached from the image forming position.

In a configuration where the pressing members 38 are placed in front of the bosses 65 (upstream in the direction of the movement in which the unit frame 5 is moved from the drawn-out position to the housing position), particularly, there is a possibility that the bosses 65 may be detached from the pressing members 38 by a shock caused when the unit frame 5 is placed at the housing position. However, the restricting member 52 is placed in rear of the bosses 65 (downstream in the movement direction). When the unit frame 5 is moved from the drawn-out position to the housing position, therefore, the bosses 65 can be prevented from being detached from the pressing members 38.

(6) Effect 6

The tandem type drum unit 3 includes the separating members 40 which move the developing cartridges 8 in the attachment posture, in the direction opposite to the direction of the pressing by the pressing members 38. The direction of the movement of the developing cartridge 8 by the separating member 40 is different from the direction along the first path D1. Therefore, the restricting member 52 does not impede the movement of the developing cartridge 8 by the separating member 40. As a result, it is possible to prevent the developing cartridge 8 from being accidentally detached from the image forming position without impeding the movement of the developing cartridge 8 by the separating member 40.

(7) Effect 7

Since the developing cartridge 8 can be prevented from being detached from the image forming position, the excellent pressing state (contacting state) of the developing roller 10 with respect to the photosensitive drum 6 can be ensured. As a result, a high-quality image can be formed on the sheet P.

(8) Effect 8

In the unit frame 5 of the tandem type drum unit 3, the positioning portion 73 is disposed in the outer side surface of the left side plate 31. The tandem type drum unit 3 is urged from the right side toward the left side in the state where the unit is located in the housing position of the body casing 2. This urging causes the positioning portion 73 to butt against the left inner side surface in the body casing 2, and the tandem type drum unit 3 (the unit frame 5) is laterally positioned. By contrast, the restricting members 52 are disposed on the right side plate 32, and the direction from the unrestricted positions toward the restricted positions coincides with the leftward direction. Even when the restricting portion 56 of the restricting member 52 butts against the developing cartridge 8, therefore, no influence is exerted on the lateral positioning of the tandem type drum unit 3. Consequently, the tandem type drum unit 3 can be laterally positioned with high accuracy.

9. Modification

Although the embodiment has been described, the invention may be performed in other modes. In the embodiment described above, for example, the developing cartridges 8 are used as an example of the cartridges in the invention. However, the example of the cartridges in the invention may be toner cartridges which do not include the developing roller 10.

Various other design changes may be performed within the aspect of the disclosure.

What is claimed is:

1. An image forming apparatus comprising:

a body;

a holding member configured to be movable between a housing position where the holding member is accommodated in the body, and a drawn-out position where the holding member is drawn out to an outside of the body;

a first cartridge configured to be attached to the holding member, along a first attachment path, at a first image forming position and to be held in the holding member;

a second cartridge configured to be attached to the holding member, along a second attachment path, at a second image forming position and to be held in the holding member;

a first restricting member disposed correspondingly with the first cartridge when the first cartridge is attached to the holding member; and a second restricting member disposed correspondingly with the second cartridge when the second cartridge is attached to the holding member, wherein the first and second restriction members are movably provided to the holding member such that the first and second restriction members move based on movement of the holding member, wherein the first cartridge and the second cartridge are arranged in a movement direction of the holding member, wherein, in a state where the holding member is in the drawn-out position, the first restricting member is located at a first unrestricted position that is retracted from the first attachment path and the second restricting member is located at a second unrestricted position that is retracted from the second attachment path, and wherein, in an attachment process in which the holding member is moved from the drawn-out position to the housing position, the first restricting member is moved from the first unrestricted position to a first restricting position on the first attachment path to restrict the first cartridge from being detached from the first image forming position and the second restricting member is moved from the second unrestricted position to a second restricting position on the second attachment path to restrict the second cartridge from being detached from the second image forming position.

2. An image forming apparatus comprising:

a body having a butting member disposed therein;

a holding member configured to be movable between a housing position where the holding member is accommodated in the body, and a drawn-out position where the holding member is drawn out to an outside of the body;

a first cartridge configured to be attached to the holding member, along a first attachment path, at a first image forming position and to be held in the holding member;

a second cartridge configured to be attached to the holding member, along a second attachment path, at a second image forming position and to be held in the holding member;

a first restricting member disposed correspondingly with the first cartridge when the first cartridge is attached to the holding member; and a second restricting member disposed correspondingly with the second cartridge when the second cartridge is attached to the holding member, wherein the first cartridge and the second cartridge are arranged in a movement direction of the holding member, wherein, in a state where the holding member is drawn out to the drawn-out position, the first restricting member is located at a first unrestricted position that is retracted from the first attachment path and the second restricting member is located at a second unrestricted position that is retracted from the second attachment path, wherein, in an attachment process in which the holding member is moved from the drawn-out position to the housing position, the first restricting member is moved from the first unrestricted position to a first restricting position on the first attachment path to restrict the first cartridge from being detached from the first image forming position and the second restricting member is moved from the second unrestricted position to a second restricting position on the second attachment path to restrict the second cartridge from being detached from the second image forming position, and wherein the first and second restricting members at the first and second unrestricted positions, respectively, are projected from the holding member, and, in the attachment process, portions which are projected from the holding member abut against the butting member to move the first and second restricting members from the first and second unrestricted positions to the first and second restricting positions, respectively.

3. The image forming apparatus according to claim 1 further comprising a first urging member configured to urge the first restricting member toward the first unrestricted position.

4. The image forming apparatus according to claim 3 further comprising a second urging member configured to urge the second restricting member toward the second unrestricted position.

5. An image forming apparatus comprising:

a body;

a holding member configured to be movable between a housing position where the holding member is accommodated in the body, and a drawn-out position where the holding member is drawn out to an outside of the body;

a first cartridge configured to be attached to the holding member, along a first attachment path, at a first image forming position and to be held in the holding member, the first cartridge including a first case and a first restricted portion which is outwardly projected from the first case;

a second cartridge configured to be attached to the holding member, along a second attachment path, at a second image forming position and to be held in the holding member, the second cartridge including a second case and a second restricted portion which is outwardly projected from the second case;

a first restricting member disposed correspondingly with the first cartridge when the first cartridge is attached to the holding member; and a second restricting member is disposed correspondingly with the second cartridge when the second cartridge is attached to the holding member, wherein the first cartridge and the second cartridge are arranged in a movement direction of the holding member, wherein, in a state where the holding member is drawn out to the drawn-out position, the first restricting member is located at a first unrestricted position that is retracted from the first attachment path and the second restricting member is located at a second unrestricted position that is retracted from the second attachment path, wherein, in an attachment process in which the holding member is moved from the drawn-out position to the housing position, the first restricting member is moved from the first unrestricted position to a first restricting position on the first attachment path to restrict the first cartridge from being detached from the first image forming position and the second restricting member is moved from the second unrestricted position to a second restricting position on the second attachment path to restrict the second cartridge from being detached from the second image forming position, wherein the first restricting member at the first restricting position is opposed to the first restricted portion of the first cartridge which is placed at the first image forming position with a first predetermined gap formed between the first restricting member and the first cartridge, and wherein the second restricting member at the second restricting position is opposed to the second restricted portion of the second cartridge which is placed at the second image forming position with a second predetermined gap formed between the second restricting member and the second cartridge.

6. The image forming apparatus according to claim 5, wherein a length of the first predetermined gap is the same as that of the second predetermined gap.

7. The image forming apparatus according to claim 5, further comprising first and second pressing members configured to respectively press the first and second cartridges placed at their respective first and second image forming positions and position the first and second cartridges with respect to the holding member, wherein the first attachment path is defined by:

a first path through which the first cartridge is passed when the first cartridge is displaced between an attachment posture that is formed when the first cartridge is placed at the first image forming position, and a release posture which is formed when pressing by the first pressing member on the first cartridge is released; and a second path through which the first cartridge is passed when the first cartridge is displaced between the release posture and a state where the first cartridge is detached from the holding member, and wherein the second attachment path is defined by:

a third path through which the second cartridge is passed when the second cartridge is displaced between an attachment posture that is formed when the second cartridge is placed at the second image forming position, and a release posture which is formed when pressing by the second pressing member on the second cartridge is released; and a fourth path through which the second cartridge is passed when the second cartridge is displaced between the release posture and a state where the second cartridge is detached from the holding member.

8. The image forming apparatus according to claim 7, wherein:

the first restricting member at the first restricting position advances into the first path, the first restricting member is placed downstream of the first restricted portion in a direction of movement of the first cartridge when the first cartridge is displaced from the attachment posture to the release posture, the second restricting member at the second restricting position advances into the third path, the second restricting member is placed downstream of the second restricted portion in a direction of movement of the second cartridge when the second cartridge is displaced from the attachment posture to the release posture.

9. The image forming apparatus according to claim 7 further comprising a separating member configured to move the first and second cartridges in the attachment posture, in a direction opposite to a direction of the pressing by the first and second pressing members.

10. The image forming apparatus according to claim 1 further comprising first and second photosensitive members configured to be held by the holding member, the first and second photosensitive members being arranged side by side in the movement direction, and extending in a direction perpendicular to the movement direction, wherein the first cartridge includes a first developing cartridge which is disposed correspondingly with the first photosensitive member, and which has a developer carrier configured to carry a developer that is to be supplied to the first photosensitive member, and wherein the second cartridge includes a second developing cartridge which is disposed correspondingly with the second photosensitive member, and which has a developer carrier configured to carry a developer that is to be supplied to the second photosensitive member.

11. The image forming apparatus according to claim 10, wherein:

the holding member includes, in one end side of the first and second photosensitive members in the extending direction, a positioning portion configured to position the holding member with respect to the body, and the first and second restricting members are disposed on the other end side of the holding member in the extending direction.

* * * * *